US010549340B2

(12) United States Patent
Droste et al.

(10) Patent No.: US 10,549,340 B2
(45) Date of Patent: Feb. 4, 2020

(54) METHOD FOR MULTIPLE CASTING OF METAL STRANDS

(71) Applicants: Werner Droste, Bonn (DE); Franz Günter Hansmann, Monheim am Rhein (DE)

(72) Inventors: Werner Droste, Bonn (DE); Franz Günter Hansmann, Monheim am Rhein (DE)

(73) Assignee: Hydro Aluminium Rolled Products GmbH, Grevenbroich (DE)

( * ) Notice: Subject to any disclaimer, the term of this patent is extended or adjusted under 35 U.S.C. 154(b) by 0 days.

(21) Appl. No.: 16/362,374

(22) Filed: Mar. 22, 2019

(65) Prior Publication Data

US 2019/0217379 A1 Jul. 18, 2019

Related U.S. Application Data

(63) Continuation of application No. PCT/EP2017/074497, filed on Sep. 27, 2017.

(30) Foreign Application Priority Data

Sep. 27, 2016 (EP) ..... 16190796

(51) Int. Cl.
*B22D 11/08* (2006.01)
*B22D 11/14* (2006.01)
(Continued)

(52) U.S. Cl.
CPC ..... *B22D 11/081* (2013.01); *B22D 7/005* (2013.01); *B22D 11/003* (2013.01); *B22D 11/083* (2013.01); *B22D 11/147* (2013.01)

(58) Field of Classification Search
CPC .... B22D 11/081; B22D 11/083; B22D 11/147
See application file for complete search history.

(56) References Cited

U.S. PATENT DOCUMENTS 3,125,440 A * 3/1964 Hornak ..... B22D 11/11 75/509
4,566,523 A * 1/1986 Vaubel ..... B22D 11/0403 164/420

(Continued)

FOREIGN PATENT DOCUMENTS

DE 891 444 C 9/1953
DE 42 03 337 A1 11/1993

(Continued)

OTHER PUBLICATIONS

W. Dietz et al., Modernization and extension of a sheet ingot casthouse, Light Metals 1994, Feb. 27-Mar. 3, 1994, 7 pages, TMS.

(Continued)

*Primary Examiner* — Kevin E Yoon
(74) *Attorney, Agent, or Firm* — Reinhart Boerner Van Deuren P.C.

(57) ABSTRACT

A method for the continuous casting of metal strands. The liquid metal is simultaneously cast via a moulds into metal strands. The moulds each have a narrow side and a broad side. The moulds have a uniform narrow side so that the metal strands have equal thicknesses after casting. At least one of the moulds used has a broad side whose length differs from the length of the broad side of the other simultaneously used moulds. For each mould used, a sprue stone is provided, which is arranged on a casting table and is provided for receiving the starter strands. The casting of the metal strands includes a mould filling phase with a fixed casting table in which a plurality of starter strands is cast into the associated sprue stones. The casting includes a continuous casting phase in which the casting table is lowered and metal strands are cast.

9 Claims, 3 Drawing Sheets

(51) Int. Cl.
*B22D 7/00* (2006.01)
*B22D 11/00* (2006.01)

(56) References Cited

U.S. PATENT DOCUMENTS

| | | | | |
|---|---|---|---|---|
| 4,730,660 | A | 3/1988 | Tinnes et al. | |
| 5,343,933 | A * | 9/1994 | Schneider | B22D 11/07 164/452 |
| 6,260,603 | B1 * | 7/2001 | Vuignier | B22D 11/147 164/453 |

FOREIGN PATENT DOCUMENTS

| | | | |
|---|---|---|---|
| DE | 43 06 943 | A1 | 9/1994 |
| DE | 4306943 | A1 | 9/1994 |
| JP | S63-150738 | U | 10/1988 |
| JP | H06-91351 | A | 4/1994 |
| JP | H07-1083 | A | 1/1995 |
| JP | H08-174169 | A | 7/1996 |
| JP | 2009-226470 | A | 10/2009 |
| WO | WO 2011/056078 | A1 | 5/2011 |
| WO | WO 2012/053896 | A1 | 4/2012 |

OTHER PUBLICATIONS

A. Hakonsen et al., Successful Implementation of a New Rolling Slab Casting Technology, AFM, within Hydro, Light Metals 2016, Feb. 7, 2016, 6 pages, TMS.

* cited by examiner

METHOD FOR MULTIPLE CASTING OF METAL STRANDS

CROSS-REFERENCE TO RELATED PATENT APPLICATIONS

This patent application is a continuation of PCT/EP2017/074497, filed Sep. 27, 2017, which claims priority to European Application No. 16190796.9, filed Sep. 27, 2016, the entire teachings and disclosure of which are incorporated herein by reference thereto.

FIELD

The invention relates to a method for the continuous casting of metal strands, in particular of rolling ingots made of aluminium or an aluminium alloy, in which

- the liquid metal is simultaneously cast via a plurality of moulds into a plurality of metal strands,
- the moulds each have a narrow side and a broad side, wherein all moulds have a uniform length of the narrow side, so that the metal strands have approximately equal thicknesses after casting,
- at least one of the moulds used has a broad side whose length differs from the length of the broad side of the other simultaneously used moulds,
- for each mould used, a sprue stone is provided, which is arranged on a casting table and is provided for receiving the starter strands,
- wherein the casting of the metal strands comprises a mould filling phase with a fixed casting table, in which a plurality of metal strands is cast into the associated sprue stones, and
- the casting comprises a continuous casting phase in which the casting table is lowered and a plurality of metal strands is simultaneously cast.

BACKGROUND

The simultaneous casting of a plurality of metal strands using moulds of different formats is already known from the prior art. A corresponding method has already been described in the patent DE 891 444. Also, from the article "Modernization and extension of a sheet ingot casthouse", W. Dietz, K. Erke, Light Metal, 1994, pp. 815-819, a method for casting aluminium ingots with different dimensions and the same thickness of approximately 600 mm is known, in which, in the case of different formats of the moulds, the respective mould filling phase for the mould begins at different times, depending on the format of the mould, so that the metal level necessary for the continuous casting in all moulds is reached at the same time. Only then the continuous casting phase is initiated. The mould filling phase for smaller size moulds is initiated up to 120 seconds later.

Furthermore, from the published patent application DE 42 03 337 A1 a method for continuous casting of a plurality of metal strands having different dimensions is known, in which a pressurised gas is introduced into the mould cavity. Details about the casting practices used are not mentioned, i.e. in particular when and how the mould filling phase is initiated for various formats.

As explained in particular in the article mentioned above, the starting practices, i.e. the casting parameters during the mould filling phase, but also the continuous casting practices, are determined depending on the particular format of the mould. The simultaneous casting of metal strands of different formats is made possible in a simple manner in that the formats of the cast metal strands, for example, have an identical thickness. The withdrawal speed in metal strand casting or ingot casting is determined essentially by the cooling behaviour of the ingot or strand and thus by the thickness of the ingot or of the metal strand. The casting of the moulds, i.e. the mould filling phase, usually takes place as quickly as possible in order to maximise the capacity of the foundry. The same aspect therefore applies to the design of sprue stones. The use of sprue stones in general is necessary to achieve a uniform casting process and to cast a rolling ingot, for example, which has relatively homogeneous properties.

The sprue stones of small format moulds have therefore usually been cast with short depth sprue stones. This reduces waste per rolling ingot, for example, and shortens the mould filling phase. Short sprue stones are also technically possible due to less distortion of the rolling ingots in smaller formats. This has to do with the fact that the shrinkage effects are greater in a large-format rolling ingot than in a small-format rolling ingot. Therefore, the mould filling phase has been previously practiced with different filling rates in order to run through them as quickly as possible. Simultaneously, different, in particular flat, sprue stones were used for small-format moulds, while deeper sprue stones were used for large-format moulds.

However, it has been shown that problems increasingly arise during the multiple casting of metal strands with different formats and mould filling phases individually tailored to the mould format. For example, in the case of critical temperature control, metal can freeze in feed systems, for example in the casting tube or the casting nozzle. Surface defects such as cold runs or, conversely, leakage out of rolling ingots can also occur. In the smaller formats, for example, the metal distributor can freeze to the base plate of the solidifying strand due to insufficient temperature control. This can lead to increased production rejects.

Despite these difficulties, preferably different formats of rolling ingots are cast in order to make optimum use of the furnace capacity of the melting furnace. In particular, if only identical formats are cast, this may present the problem that a larger metal sump remains in the furnace, which cannot be cast to a complete ingot/metal strand.

On this basis, the present invention has as its object to provide a method for continuous casting of metal strands, in particular of rolling ingots made of aluminium or an aluminium alloy, which allows the continuous casting of rolling ingots/metal strands of different formats with a reduced reject rate.

BRIEF SUMMARY

According to the present invention, the object is achieved in that the depth of the sprue stone for each mould is at least 50 mm, the mould filling phase is started simultaneously for all moulds with an identical filling speed, the casting process for the moulds that have reached the necessary metal level for starting the continuous casting phase is stopped and the continuous casting phase is started as soon as all moulds have reached the metal level necessary for the continuous casting phase.

The filling speed is specified as the increase of the molten metal in the mould or in the sprue stone relative to the mould during the mould filling phase. Therefore, moulds with a small format require a smaller metal volume flow than large-format moulds in order to achieve an identical filling speed in the mould filling phase. Thus, starting the mould filling phase simultaneously, theoretically, all moulds, regardless of format, reach the metal level necessary for the continuous casting phase at the same time. In practice, however, the moulds reach the necessary metal level for the continuous casting phase at different times, for example within a few seconds. This is in part due to the system technology used to start the filling process, but deviations in the filling process also result from the simultaneous casting of a plurality of metal strands due to the filling of the molten metal in the mould. Therefore, according to the invention, for all moulds which have reached the necessary metal level, the casting process is stopped until all moulds have reached the necessary metal level and the continuous casting phase is initiated by lowering the casting table.

In contrast to the previous methods, sprue stones are used for each mould that are at least 50 mm deep. Due to the sprue stone being provided with the minimum depth of 50 mm no difficulties arise in restarting the casting process, for example in moulds with small formats, despite a possible interruption of the casting process in these moulds. The sprue stone serves as a heat reservoir and provides heat for the continuation of the casting process. Regardless of the format of the mould, the heat reservoir of the sprue stone significantly reduces the particular risk of solidification of the meniscus of the molten metal on the mould, even when stopping the casting process, and the metal meniscus in the mould remains liquid, especially in the contact area with the mould. As a result, casting defects can be reduced to a considerable extent. Surprisingly, it has been found that it is also economically worthwhile to accept a larger amount of metal waste caused by the separation of the ingot foot in small-sized ingots due to the larger sprue stone depth, as this is accompanied by a significantly lower reject rate in relation to the finished rolling ingots. As a result, a method can be provided which produces significantly fewer waste ingots or strands despite the use of different formats.

Preferably, the depth of the used sprue stone of the moulds is 100 mm to 150 mm to provide an even larger heat reservoir. At these sprue stone depths, particularly low failure rates were determined in the multiple casting of metal strands having different formats. At the same time, the amount of waste metal when separating the ingot foot is limited.

It has also proven to be advantageous if the sprue stones of moulds with different mould formats have an identical depth. Again, it was found that by using sprue stones of identical depths, a reduction in the reject rate in the production of rolling ingots could be achieved.

The mould filling phase preferably has a duration of 90 seconds to 600 seconds, preferably 120 seconds to 480 seconds. The filling speed during the mould filling phase may preferably correspond to the lowering speed of the casting table in the continuous casting phase. Despite the greater time involved, it has been found that the productivity of the multi-strand caster is not adversely affected due to the lower reject rate of the cast ingots or metal strands.

With the method according to the invention, preferably, a plurality of moulds having a broad side length of 900 mm to 2200 mm is used simultaneously, wherein the narrow sides thereof have a substantially uniform length of 400 mm to 600 mm. With the specified mould formats, the formats of rolling ingots commonly used today are completely covered and thus offer a high flexibility in the production of the rolling ingots and the exploitation of the capacity of an upstream molten metal furnace.

Preferably, during the mould filling phase, the metal level in the sprue stone is measured contactlessly, for example capacitively, via a metal sensor, which is movable at least parallel to the broadside direction of the moulds, and the continuous casting phase is initiated depending on the metal level. A capacitive measurement of the metal level has proven to be particularly robust and accurate. It therefore enables process-reliable control of the initiation of the continuous casting phase. In principle, measurements using laser, radar and other non-contact probes are also possible.

Preferably, the casting cross-section is controlled automatically using a metal level control device, so that both the mould filling phase and the continuous casting phase can take place with a controlled casting cross-section. The metal level in the moulds can, for example, be temporally predetermined using a "casting formula".

In addition, it has been found that in particular the low-alloyed aluminium alloys of the type AA1xxx and AA8xxx as well as alloys of the type AA3xxx and AA6xxx can be cast satisfactorily into metal strands using the method according to the invention. The alloy types differ during casting by their solidification behaviour. While low-alloyed aluminium alloys, for example the alloy types AA1xxx or AA8xxx, form a substantially uniform solidification front, higher alloyed AA3xxx and AA6xxx alloys show a slurry-like solidification front. For example, it has to be reacted with different mould filling speeds and lowering speeds to the different alloys. The casting results of the AA3xxx and AA6xxx alloy were improved at, for example, higher mould filling speeds. But it is also conceivable to cast other, for example, higher alloyed aluminium alloys with a corresponding method.

In the aforementioned formats for the narrow and broad sides of a mould, preferably the broad side length of the moulds is selected such that the furnace sump of an upstream melting furnace can be minimised. In other words, depending on the amount of molten metal and the furnace-specific furnace sump, the formats are chosen such that, if possible, only an unavoidable residue remains in the sump of the melting furnace. This ensures that a subsequent change to a different alloy can be carried out as quickly as possible and therefore cost-effectively.

BRIEF DESCRIPTION OF THE DRAWING

In the following, the invention will be explained in more detail with reference to embodiments in conjunction with the drawings, wherein the drawing shows in FIG. 1 shows a schematic cross-sectional view of a device for casting a metal strand.

DETAILED DESCRIPTION

Figure 1:
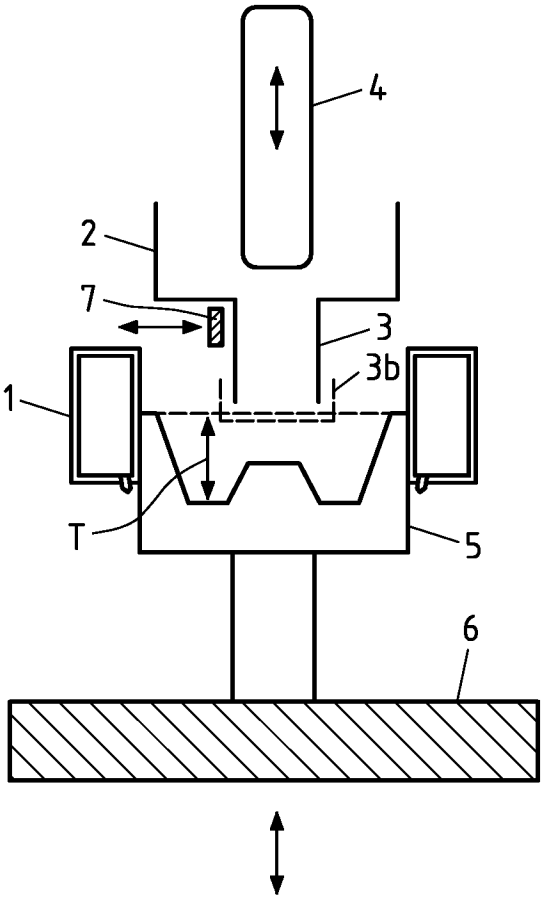

FIG. 1 shows, in a schematic cross-sectional view in one embodiment, the principle of continuous casting of a metal strand using a mould 1, a distributor channel 2, a casting tube or a casting nozzle 3, a distribution network 3*b*, a stopper 4 and a sprue stone 5, which is arranged on a casting table 6. The casting table 6 is movable in height and, during the continuous casting, is inserted in a water bath, for example for cooling purposes. The mould 1 is water-cooled and can additionally deliver cooling water to the metal strand emerging downwards on the sides facing the metal strand in order to additionally cool the outer walls of the metal strand. In addition, a metal sensor 7 may be provided for detecting the metal level, which, as the arrows indicate, can, for example, be displaceably arranged in the direction of the broad side of the mould 1.

The sprue stone 5 in the illustrated embodiment in FIG. 1 is formed such that an elevation is provided in its centre. The elevation in the centre is optional. Towards the edge, the sprue stone 5 has a depth T, which according to the invention is at least 50 mm. The depth T of the sprue stone is preferably 100 mm to 150 mm in order to provide a sufficient heat reservoir for the molten metal in the method according to the invention, irrespective of the mould format, and to increase the process reliability of the method according to the invention. In the distributor 2 is the supply of liquid molten metal 8, which is replenished via a pan (not shown) or via a furnace during the casting process. In the inlet channel between the metal reservoir and distributor channel 2, in-line aggregates for melt treatment, for example degassers, filters or grain refiners, can be inserted. By means of the stopper 4, the casting opening of the casting tube 3 can be set to the different formats of the moulds 1 and the casting speed can be adjusted accordingly. The distribution network 3*b* below the casting tube, also known as a "combo bag" or "distribution bag", serves the even distribution of the melt into the mould. In the case of large-format moulds, a larger cross section of the casting opening is provided in comparison with small-format moulds. This ensures that with simultaneous continuous casting of different formats an identical withdrawal speed is made possible by lowering the common casting table 6 for all moulds. Preferably, the casting cross-section is controlled automatically via a metal level control device. The target value of the metal level in the moulds can, for example, be temporally predetermined using a "casting formula".

Figure 2:
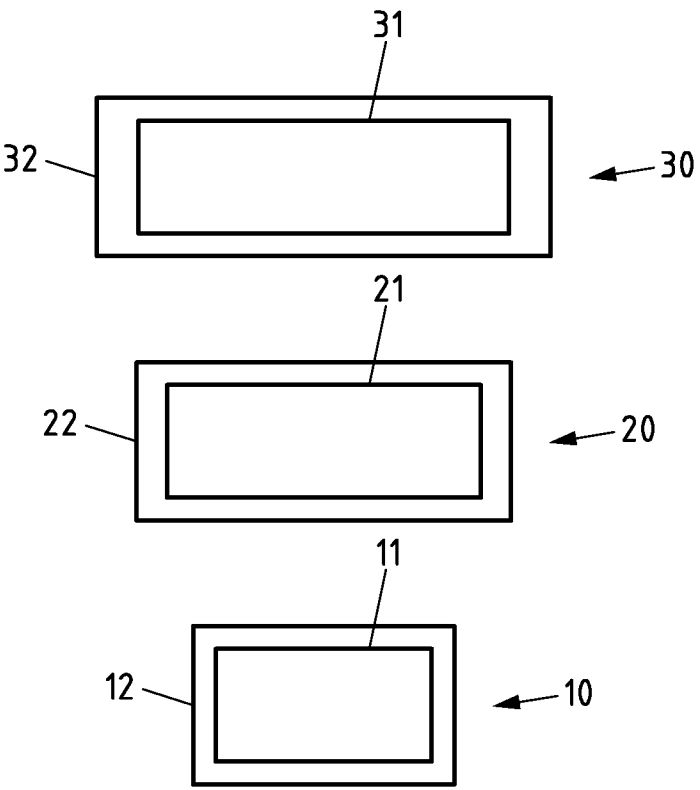
FIG. 2 shows, in a plan view 3 different moulds with different broad side lengths.

FIG. 2 shows, in a schematic plan view, 3 different moulds 10, 20, 30, which are distinguished by a broad side 11, 21, 31 of different length and identical narrow sides 12, 22, 32. The narrow sides 12, 22, 32 define the thickness of the withdrawn metal strand and, according to the invention, have an identical length. The thickness of the metal strand essentially determines the cooling behaviour of the metal strand and thus the withdrawal speed of the metal strand. When casting different formats with a common casting table 6, a substantially identical cooling behaviour of the various metal strands can therefore be achieved in a simple manner by identical length narrow sides.

Figure 3:
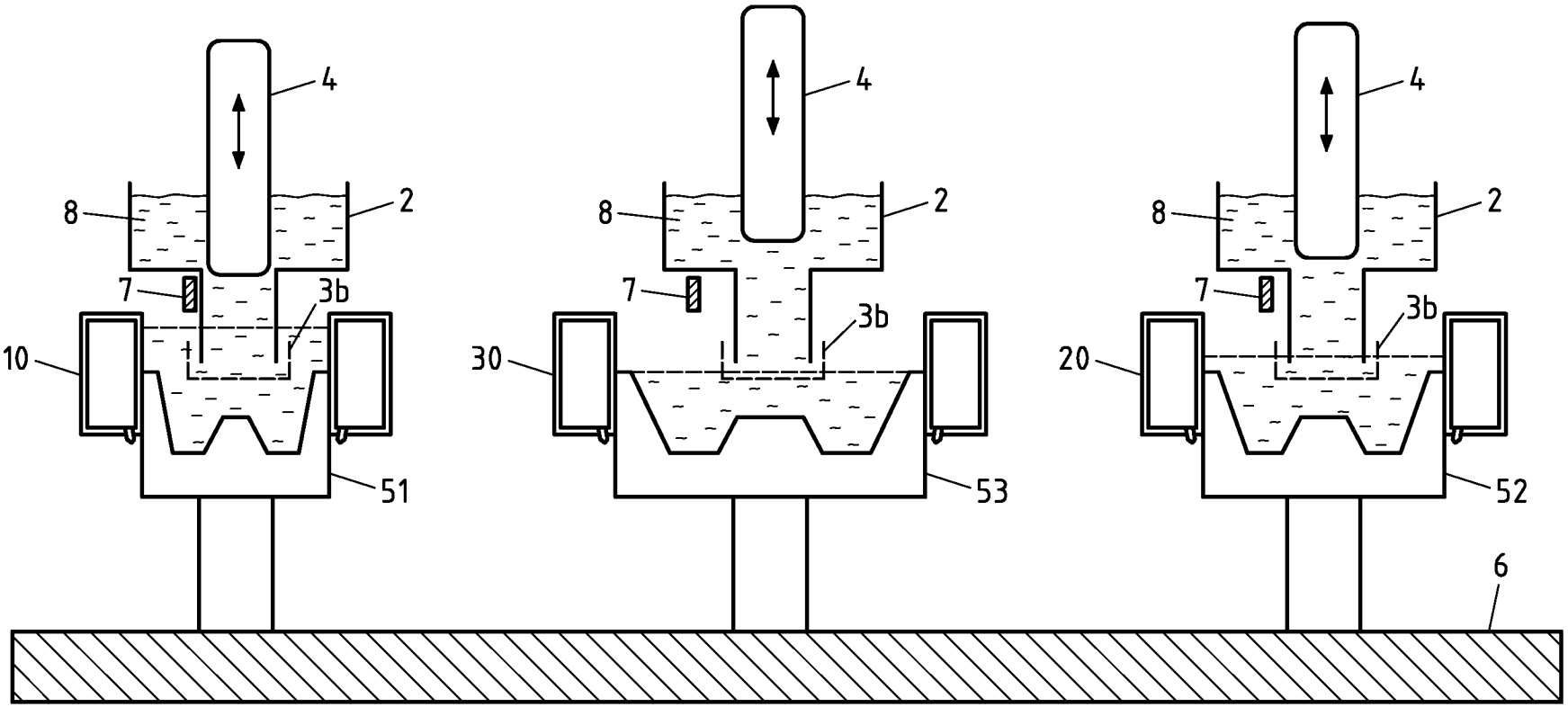
FIG. 3 shows, in a schematic cross-sectional view a device for simultaneous casting of a plurality of metal strands in the mould filling phase according to an embodiment of the present invention.

FIG. 3 shows a schematic cross-sectional view of an exemplary embodiment of a method according to the invention for continuous casting of metal strands, in particular of rolling ingots of aluminium or an alloy, in which the liquid metal 8 is distributed, for example via distributors 2, to a plurality of moulds 10, 20, 30. The mould filling phase begins for all moulds 10, 20, 30 at the same time. According to the present invention, 'at the same time' means that the casting operations are initiated simultaneously, wherein, however, in practice, the system technology may also lead to a shift by several seconds between individual moulds.

FIG. 3 shows the mould filling phase of an exemplary embodiment of the method according to the invention at a point in time at which a mould has already reached the metal level necessary for introducing the continuous casting phase. However, the moulds 30 and 20 need to be further filled to achieve the desired metal level. Due to the depths of at least 50 mm provided in the sprue stone 51, 52 and 53, in particular in the sprue stone 51, a molten metal reservoir is provided which provides enough heat to enable the casting process in the mould 10, which has first reached the metal level for the continuous casting, to be stopped without causing freezing of the metal meniscus. The depth of the sprue stone is preferably 100 mm to 150 mm.

Figure 4:
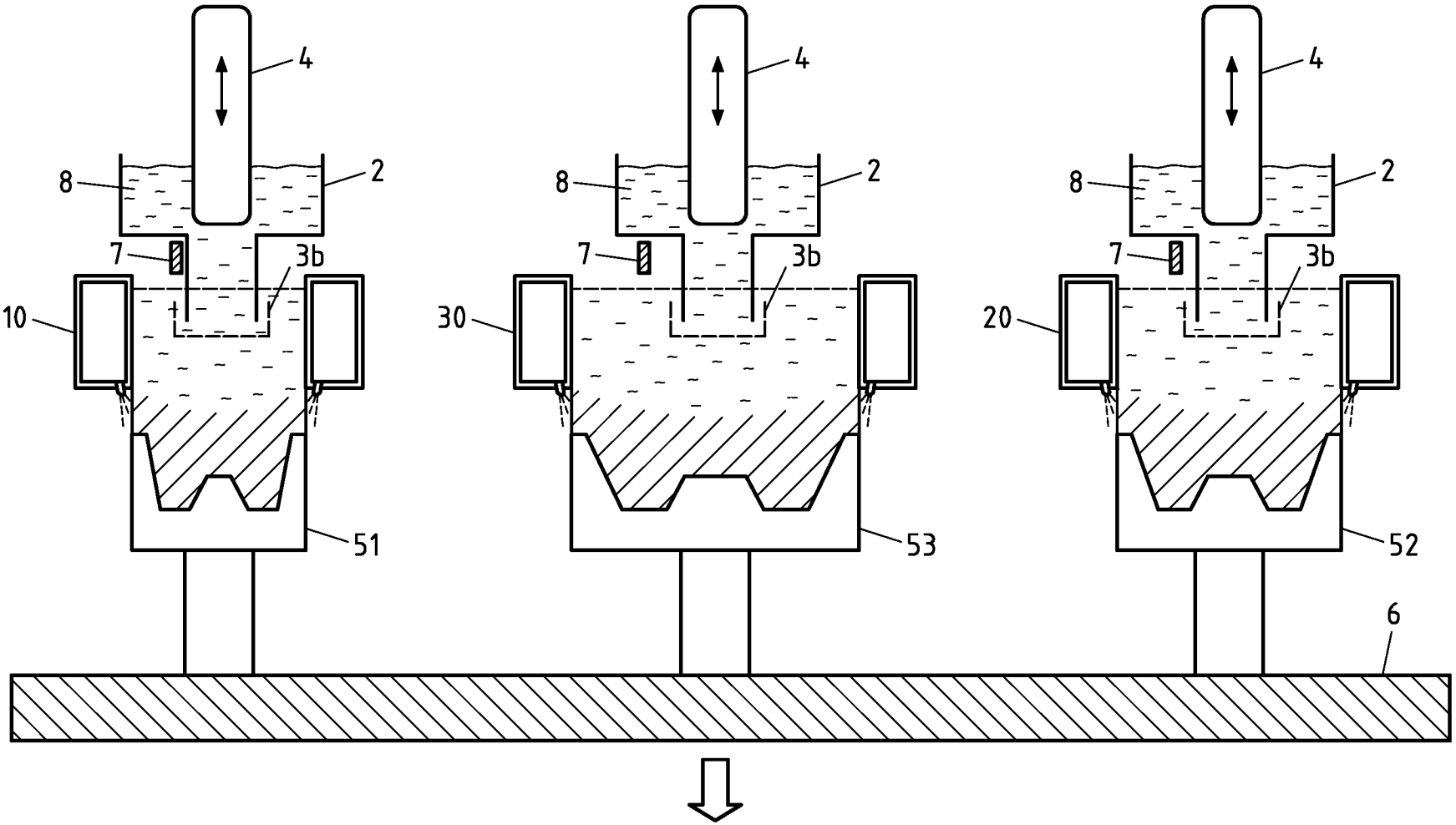
FIG. 4 shows, in a schematic cross-sectional view the embodiment of FIG. 3 during the continuous casting phase.

After the other moulds 20, 30 have also reached the metal level necessary for the introduction of the continuous casting phase, which is measured by the metal sensor 7, the continuous casting phase is started and the common casting table 6 is lowered, FIG. 4. As can be seen in the exemplary embodiment in FIG. 3, the sprue stones of the different moulds 10, 20, 30 preferably have an identical depth.

In contrast to the usual casting practices, which determine the mould filling phase, the mould filling phase can be performed relatively slowly. The mould filling phase preferably has a duration of 90 seconds to 600 seconds, particularly preferably 120 seconds to 480 seconds from the start of casting to the start of the continuous casting phase, i.e. the lowering of the casting table 6. The filling speed during the mould filling phase approximately corresponds, for example, to the filling speed during the continuous casting or the continuous casting phase, in which the metal strand is withdrawn from the mould 10, 20, 30 by lowering the casting table 6.

The moulds shown in the embodiment in FIG. 3 have different broad side lengths, preferably from 900 mm to 2200 mm. The narrow sides, not shown in FIGS. 3 and 4, have a uniform length of 400 mm to 600 mm.

In FIG. 4, the embodiment of FIG. 3 is now shown during the continuous casting phase. The casting table 6 is lowered during the continuous casting phase depending on the metal volume flow, with which metal is replenished in the moulds, wherein via the distributors 2 and the nozzle or the casting tube 3 liquid metal is supplied using the stopper 4 according to the lowering speed of the casting table 6. Due to the identical lowering speed for small- and large-format moulds 10, 20, 30, the cross section, which is provided to the molten metal for re-flow via the interaction of the stopper and the casting tube 3, 4, is chosen accordingly for each mould. The metal sensor 7 can constantly measure the metal level of the molten metal or of the metal and use it to control the molten metal inflow. Preferably, the metal level of the metal sensor 7 is measured contactlessly, for example capacitively. However, also a non-contact measurement with a laser, with a radar probe or inductively can be carried out.

It has been found, in particular, that aluminium alloys of the type AA1xxx, AA3xxx, AA6xxx, or aluminium alloys of the type AA8xxx are particularly suitable for continuous casting using a plurality of moulds with different formats, since the low-alloyed aluminium alloys AA1xxx and AA8xxx have a good casting behaviour and thus the reject rate during multiple continuous casting is further reduced. However, also the alloys of the type AA3xxx and AA6xxx having a critical estimable solidification behaviour have already been successfully cast with the method according to the invention.

In the present embodiment of FIGS. 3 and 4, the broad side lengths of the moulds 10, 20, 30 were chosen so that after the casting of the metal strands, the amount of metal in the furnace sump of the associated melting furnace is particularly low.

In particular, the choice of the sprue stone depth in conjunction with the simultaneous casting start in the mould filling phase makes it possible to cast metal strands or rolling ingots with different formats simultaneously with a very low reject rate.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method for the continuous casting of metal strands, including rolling ingots made of aluminium or an aluminium alloy, in which the liquid metal is simultaneously cast via a plurality of moulds into a plurality of metal strands, the moulds each have a narrow side and a broad side, wherein all moulds have a uniform length of the narrow side, so that the metal strands have equal thicknesses after casting, at least one of the moulds used has a broad side, whose length differs from the length of the broad side of the other simultaneously used moulds, for each mould used, a sprue stone is provided, which is arranged on a casting table and is provided for receiving the starter strands, wherein the casting of the metal strands comprises a mould filling phase with the casting table fixed, in which a plurality of starter strands is cast into the associated sprue stones, and the casting comprises a continuous casting phase in which the casting table is lowered and a plurality of metal strands is cast, wherein the depth of the sprue stone for each mould is at least 50 mm, the mould filling phase is started simultaneously for all moulds with an identical filling speed, the casting process for the moulds that have reached the necessary metal level for starting the continuous casting phase is stopped and the continuous casting phase is started as soon as all moulds have reached the metal level necessary for the continuous casting phase.

2. The method according to claim 1, wherein the depth of the sprue stone is 100 mm to 150 mm.

3. The method according to claim 1, wherein the sprue stones of moulds with different mould formats have an identical depth.

4. The method according to claim 1, wherein the mould filling phase has a duration of 90 s to 600 s.

5. The method according to claim 1, wherein a plurality of moulds having a broad side length of 900 mm to 2200 mm is used simultaneously, whose narrow sides have a uniform length of 400 mm to 600 mm.

6. The method according to claim 1, wherein during the mould filling phase, the metal level in the sprue stone is measured contactlessly, via a metal sensor, which is movable at least parallel to the broadside direction of the moulds, and the continuous casting phase is initiated depending on the metal level in the moulds.

7. The method according to claim 1, wherein aluminium alloys of the type AA1xxx or AA8xxx, AA3xxx and AA6xxx are cast.

8. The method according to claim 1, wherein the mould filling phase has a duration of 120 s to 480 s.

9. The method according to claim 6, wherein the metal sensor measures the metal level in the sprue stone capacitively.

* * * * *